US009450281B2

(12) United States Patent
Kim

(10) Patent No.: US 9,450,281 B2
(45) Date of Patent: Sep. 20, 2016

(54) TRANSIT STRUCTURE OF WAVEGUIDE AND SIW

(71) Applicant: HYUNDAI MOBIS CO., LTD., Seoul (KR)

(72) Inventor: Sung Joo Kim, Yongin (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 22 days.

(21) Appl. No.: 14/592,705

(22) Filed: Jan. 8, 2015

(65) Prior Publication Data

US 2016/0111764 A1 Apr. 21, 2016

(30) Foreign Application Priority Data

Oct. 16, 2014 (KR) ..... 10-2014-0139905

(51) Int. Cl.
*H01P 5/08* (2006.01)
*H01P 5/02* (2006.01)

(52) U.S. Cl.
CPC ..... *H01P 5/024* (2013.01)

(58) Field of Classification Search
CPC ..... H01P 5/024; H01P 5/087; H01P 11/002
USPC ..... 333/21 R, 26, 33
See application file for complete search history.

(56) References Cited

U.S. PATENT DOCUMENTS 6,509,809 B1 1/2003 Lynch
7,750,755 B2 * 7/2010 Fujita ..... H01P 5/107 333/26
7,907,031 B2 * 3/2011 Kim ..... H01P 5/1022 333/21 R

FOREIGN PATENT DOCUMENTS

JP 4453696 B2 4/2010
JP 2011-61258 A 3/2011
KR 10-0576552 B1 4/2006
KR 10-0714451 B1 4/2007
KR 10-2011-0086784 A 8/2011

OTHER PUBLICATIONS

R. Glogowski et al., "Broadband Ka-band rectangular waveguide to substrate integrated waveguide transition", Electronics Letters, Apr. 25, 2013, pp. 1-2, vol. 49, No. 9.

* cited by examiner

*Primary Examiner* — Robert Pascal
*Assistant Examiner* — Kimberly Glenn

(57) ABSTRACT

A transit structure of a waveguide and a SIW is provided. According to the present invention, a SIW and a waveguide are directly connected so that when a signal is transited with a reduced loss and a signal is transmitted while satisfying a frequency band width required for an automotive radar. Further, signal transmission characteristic at every frequency in a bandwidth may be uniformly maintained. Further, an additional dielectric substrate is not required so that a reduced size, a reduced weight, and a reduced cost may be achieved and a process of bonding different substrates is not required.

13 Claims, 11 Drawing Sheets

<PRIOR ART>

<PRIOR ART>

TRANSIT STRUCTURE OF WAVEGUIDE AND SIW

CROSS-REFERENCE TO RELATED APPLICATIONS

This application claims priority to and the benefit of Korean Patent Application No. 10-2014-0139905 filed in the Korean Intellectual Property Office on Oct. 16, 2014, the entire contents of which are incorporated herein by reference.

TECHNICAL FIELD

The present invention relates to a transit structure of a waveguide and a SIW (Substrate Integrated Waveguide), and more particularly, to a transit structure of a waveguide and a SIW which is capable of being used in a millimeter wave band.

BACKGROUND ART

Vehicles provide various conveniences to people but have many factors which threaten a safety of a passenger or a pedestrian. Therefore, vehicles are developing to improve not only the convenience but also the safety, in recent years.

As a representative technology among technologies which improve the safety of the vehicle, a vehicle collision preventing technology using an automotive radar is suggested. A radar is a sensor which transmits an electromagnetic wave and receives a reflected wave to detect and trace a distance from a target, a speed, and an angle and has been mainly used for a military purpose in the related art, but the utilization range of the radar is broadened to be used for a vehicle.

The automotive radar is mounted at a front side or a rear side of the vehicle to detect or trace another vehicle, a pedestrian, a bicycle, or a structure near the vehicle for smart cruise control (SCC) and active safety control. The automotive radar uses a frequency signal of a millimeter wave band having a frequency band of 30 to 300 GHz. The millimeter wave has a very short wavelength of 1 to 10 mm so that when transmission loss in spatial transmission is large and a transmission distance is extremely short (for example, within 10 m). However, when the millimeter wave is used, a size of a circuit or a component may be reduced and a high resolution radar may be configured.

FIG. 1 illustrates a schematic configuration of a general automotive radar.

As illustrated in FIG. 1, the automotive radar mainly includes a transmitting unit 10 and a receiving unit 20 and a number of channels of the receiving unit 20 may be variously set in accordance with a demand of an automotive radar system.

The transmitting unit 10 includes a transmission RF module (TRF) which generates an electromagnetic wave and a transmission antenna (TANT) which radiates the electromagnetic wave which is generated in the transmission RF module (TRF). A plurality of channels of the receiving unit 20 includes a reception antenna (RANT) which receives a reflected wave of the electromagnetic wave radiated from the transmitting unit 10 and a reception RF module (RRF) which receives and analyzes the reflected wave which is incident through the reception antenna (RANT).

That is, the transmitting unit 10 and the plurality of channels of the receiving unit 20 have configurations in which the RF modules TRF and RRF are basically connected to the antennas TANT and RANT, respectively. The RF modules TRF and RRF and the antennas TANT and RANT are connected to transmission lines TL, respectively and the transmission lines are connected by a waveguide, generally, a standard waveguide (SW).

In the recent automotive radar system, the antennas TANT and RANT and the transmission lines TL are embodied using a SIW in many cases.

FIG. 2 illustrates a basic structure of a general SIW.

As illustrated in FIG. 2, a SIW 30 is embodied by disposing a plurality of vias 32 in a dielectric substrate 31, such as Teflon, with a regular pattern and metal grounded surfaces are disposed in an upper portion and a lower portion of the dielectric substrate. As illustrated in FIG. 2, when a plurality of vias is arranged in the dielectric substrate 31 in two lines, a signal may be transmitted between two via lines in the dielectric substrate 31 with a reduced loss. This is because a radiation loss is not caused in the SIW having a structure closed by upper and lower metal grounded surfaces and the via lines, which is different from the transmission line which is partially open, such as a microstrip line of the related art. That is, the dielectric substrate between via lines may function as a transmission line.

Therefore, the SIW 30 may be embodied by disposing the plurality of vias 32 along a path in the dielectric substrate 31 through which a signal is transmitted. The SIW 30 have a simple structure and may be embodied using general printed circuit board (PCB) process, so that mass production may be achieved. The SIW 30 is mainly used as a transmission line for a high frequency band signal such as a millimeter wave.

In the meantime, the waveguide SW is used as a millimeter wave transit device for connecting the transmission lines with a reduced loss, as described above. However, in order for the waveguide SW to connect the transmission lines TL embodied by the SIW with a reduced loss, it is necessary to embody a transit structure which easily transits the millimeter wave from the SIW to the waveguide SW. In order to save cost for the radar system and reduce a size of the radar system, the transit structure needs to have a simple structure and be embodied using a general PCB process without having an additional structure other than a substrate which embodies the SIW. Further, a signal transition characteristic in accordance with the transit structure needs to have a frequency band which is sufficiently broader than a frequency which is operated by the radar system and uniformly transit signals in the frequency band as much as possible.

Korean Registered Patent No. 10-0714451 (titled "Transition structure of SIW and standard waveguide") discloses a transition structure in which a cavity is formed between a waveguide and a SIW to easily establish matching therebetween, but a separate substrate needs to be added to form the cavity and a process of bonding the dielectric substrates is added, which increases cost.

Further, "Broadband Ka-band rectangular waveguide to substrate integrated waveguide transition" (Electronics Letters, Apr. 24 2013)" suggests a transition structure which includes two resonating slots (dual resonating slot) to directly connect the waveguide and the SIW to each other. Such a transit structure has advantageously a broad band width (6.6% with respect to a relative band width) as compared with a transit structure including one resonating slot but does not have a uniform signal transit characteristic for a frequency due to an influence of a transmission characteristic of the dual resonating slot.

SUMMARY OF THE INVENTION

The present invention has been made in an effort to provide a transit structure of a waveguide and a SIW which may be implemented using a general PCB process without providing an additional structure other than a substrate which configures a SIW, with a simple structure and may uniformly transit a signal at a broad frequency band.

The present invention provides a transit structure of a waveguide and a SIW, including: a SIW; and a waveguide which is formed in the form of a metallic tube and is directly coupled to a lower surface of the SIW in a perpendicular direction. The SIW includes a dielectric substrate; a first conductor which is disposed on an upper surface of the dielectric substrate; a second conductor which is disposed on a lower surface of the dielectric substrate, a region of the second conductor corresponding to an aperture of the waveguide being etched to form a non-resonating slot; a plurality of vias which is disposed in the dielectric substrate in accordance with a predetermined pattern to form a transmission path through which the signal is transmitted in the SIW and an impedance matching box which transits a signal which is transmitted to the SIW or the waveguide; and a stub which is formed in a region where the non-resonating slot is formed in order to perform impedance matching between the SIW and the waveguide.

The plurality of vias may include: a plurality of first vias which is disposed in accordance with a first pattern guiding both sides of the path so as to transmit the signal along the path predetermined in the dielectric substrate to form the transmission line; and a plurality of second vias which is disposed in accordance with a second pattern so as to be spaced apart to an outer periphery of the non-resonating slot by a first interval to form the impedance matching box.

The second pattern may be formed such that the second vias are not disposed in a position where the non-resonating slot and the transmission line are connected.

The stub may be formed to be invaginated from a central axis of the transmission line which is connected to the non-resonating slot toward a central direction of the non-resonating slot.

The stub may be formed by masking a region in the second conductor corresponding to the stub so as not to be etched when the non-resonating slot is formed.

According to the present invention, a SIW and a waveguide are directly connected so that when a signal is transited with a reduced loss and a signal is transmitted while satisfying a frequency band width required for an automotive radar. Further, signal transmission characteristic at every frequency in a bandwidth may be uniformly maintained. Further, an additional dielectric substrate is not required so that a reduced size, a reduced weight, and a reduced cost may be achieved and a process of bonding different substrates is not required

DETAILED DESCRIPTION OF THE INVENTION

Figure 1:
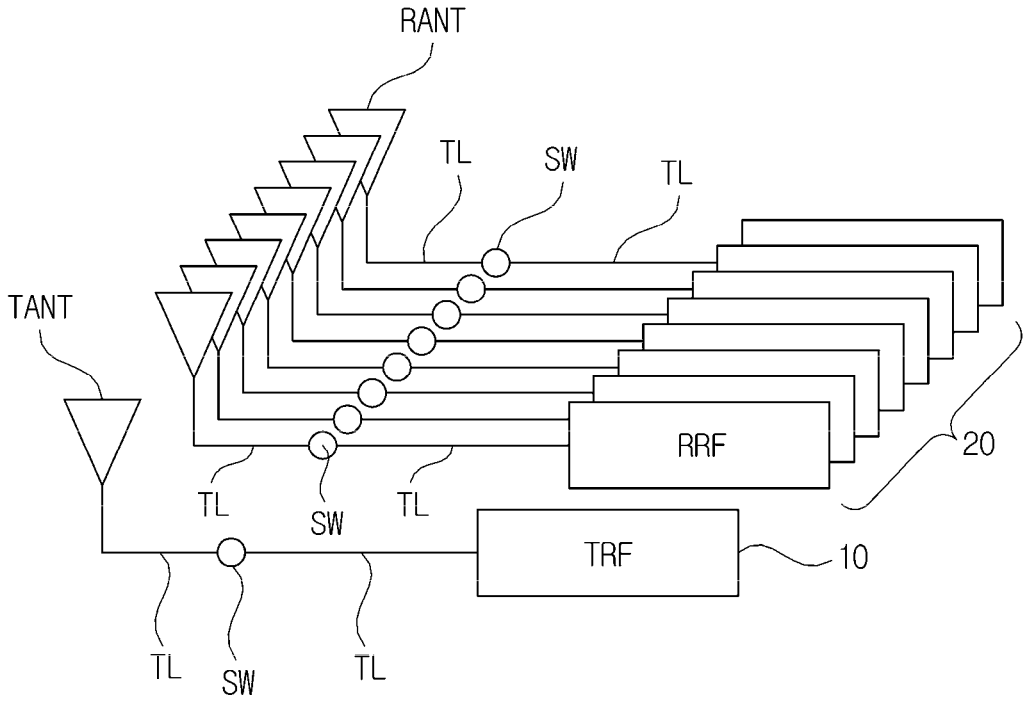
FIG. 1 illustrates a schematic configuration of a general automotive radar.

In order to sufficiently understand the present invention, the operational advantages of the present invention, and the objectives achieved by the embodiments of the present invention, the accompanying drawings illustrating preferred embodiments of the present invention and the contents described therein need to be referred to.

Hereinafter, the present invention will be described in detail by explaining preferred embodiments of the present invention with reference to the accompanying drawings. However, the present invention can be realized in various different forms, and is not limited to the exemplary embodiments described herein. In order to clearly describe the present invention, a part which may obscure the present invention may be omitted and like reference numerals denote like components.

In the specification, unless explicitly described to the contrary, the word "comprise" and variations such as "comprises" or "comprising", will be understood to imply the inclusion of stated elements but not the exclusion of any other elements. In addition, the terms "unit", "-er", "-or", "module", and "block" described in the specification mean units for processing at least one function and operation and can be implemented by hardware components or software components and combinations thereof.

Figure 3:
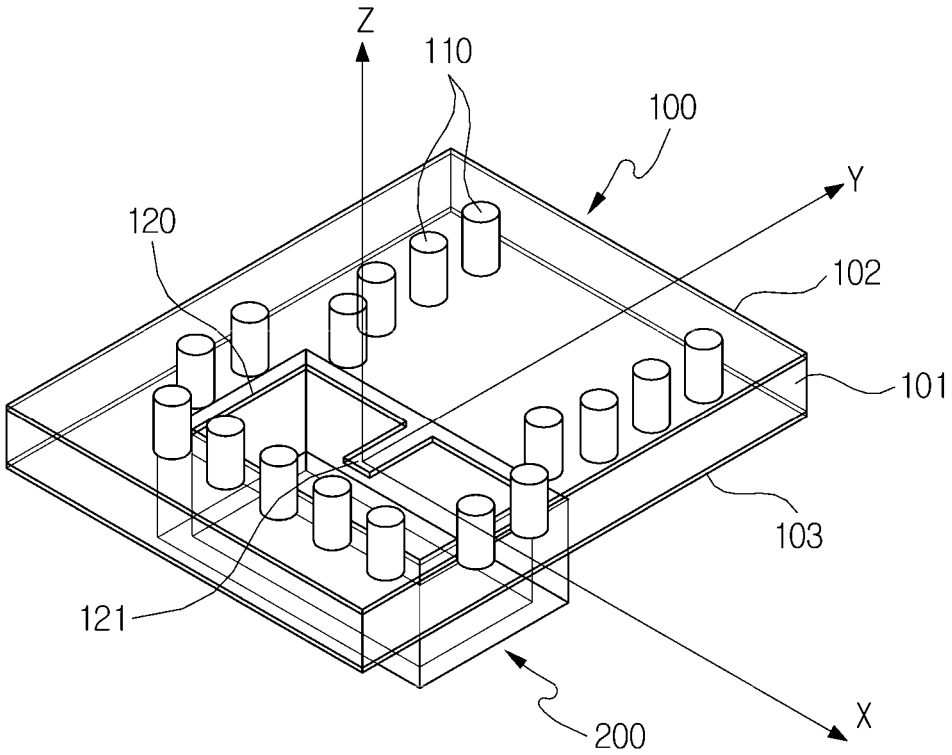
FIGS. 3 and 4 are a perspective view and a side view of a transit structure of a waveguide and a SIW according to an exemplary embodiment of the present invention.
Figure 4:
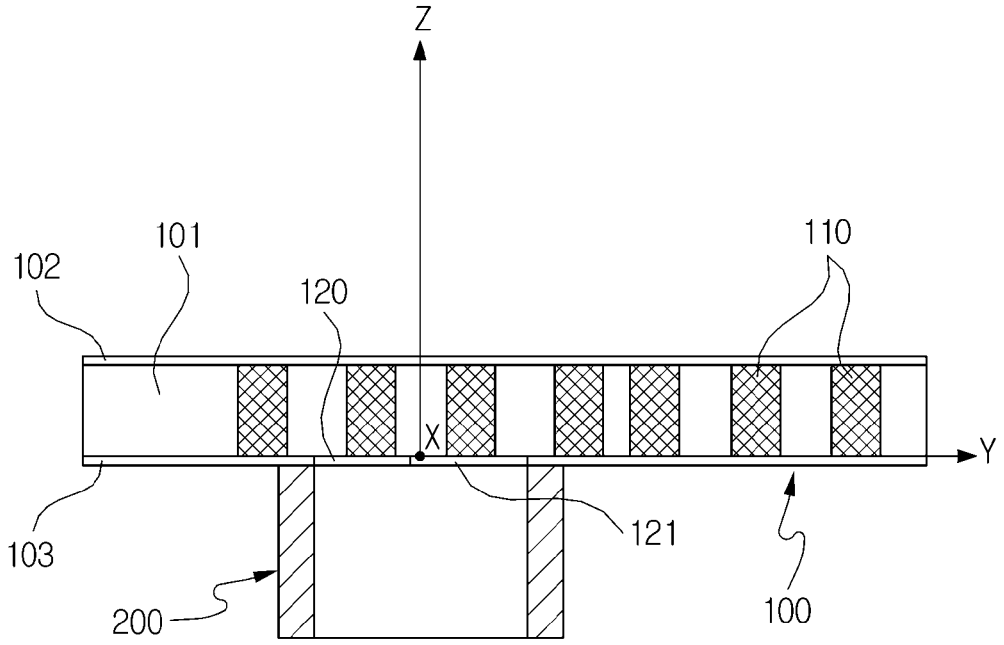

FIGS. 3 and 4 are a perspective view and a side view of a transit structure of a waveguide and a SIW according to an exemplary embodiment of the present invention.

A transit structure of a waveguide and a SIW according to an exemplary embodiment of the present invention will be described with reference to FIGS. 3 and 4. First, a waveguide 200 is directly connected to a lower surface of a SIW 100 to be perpendicular to each other.

The waveguide 200 is formed in the form of a metallic tube and one of two apertures is coupled to the lower surface of the SIW 100. The waveguide 200 is a kind of transmission line which is formed in the form of a metallic tube to transmit a high frequency (1 GHz) signal which is microwave or higher and may be embodied as a tube shape whose cross-section has various shapes including a rectangle or a circle. However, in FIGS. 3 and 4, a standard waveguide is illustrated as a representative example. A cross-section of the standard waveguide is defined as a circle or a rectangle and a size of the cross-section is designated by Electronic Industry Association in accordance with a frequency of a signal to be transmitted and a cutoff frequency.

The SIW 100 includes a dielectric substrate 101 which is embodied by Teflon or other dielectric substance, a first conductor 102 which is disposed on an upper surface of the dielectric substrate 101, a second conductor 103 which is disposed on a lower surface of the dielectric substrate 101, and a plurality of vias 110 which are inserted in the dielectric substrate 101 to electrically connect the first conductor 102 and the second conductor 103.

The plurality of vias 110 is arranged in accordance with a first pattern for forming a transmission line TL through which a millimeter wave signal is transmitted in the dielectric substrate 101 and a second pattern for transiting the signal into the waveguide 200.

Figure 2:
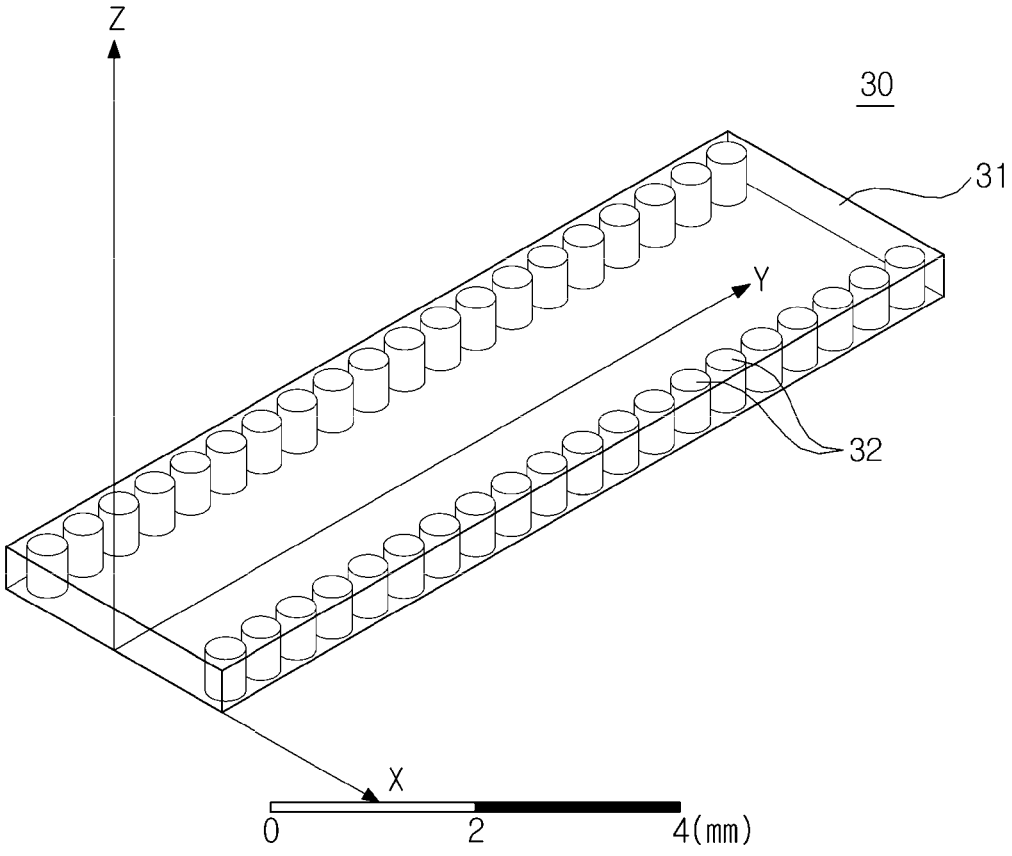
FIG. 2 illustrates a basic structure of a general SIW.

According to the first pattern, the plurality of vias 110 is disposed to be parallel in two lines as illustrated in FIG. 2 in order to form a transmission line TL which is designated in accordance with a transmission path of a signal which is transmitted into the dielectric substrate 101. The transmission line TL formed by the first pattern transmits a signal which is applied from a transmission RF module TRF or a reception antenna RANT to the waveguide 200 or a signal which is applied through the waveguide 200 to a reception RF module RRF or a transmission antenna TANT.

The second pattern has a configuration which forms an impedance matching box so as to transit the signal transmitted between the SIW 100 and the waveguide 200. According to the second pattern, the plurality of vias 110 is arranged with a predetermined interval around a coupled surface of the waveguide 200 which is coupled to the lower surface of the SIW 100. However, in the second pattern, a via 110 is not disposed in a position where the second pattern is connected to the first pattern so as to transmit the signal which is applied through the transmission path formed by the first pattern to the waveguide 200. That is, the second pattern has a configuration in which a plurality of vias is arranged to be spaced apart from the coupled surface with a predetermined first interval in a remaining region which does not overlap the transmission path formed by the first pattern around the coupled surface which is connected to the waveguide 200.

A plurality of vias which is arranged in accordance with the first pattern is referred to as first vias and a plurality of vias which is arranged in accordance with the second pattern is referred to as second vias.

A region of the second conductor 103 of the SIW 100 which corresponds to an aperture coupled to the waveguide 200 for impedance matching is etched to form a non-resonating slot 120. That is, the non-resonating slot 120 is formed by etching the second conductor 103 with a size corresponding to a size of the aperture of the waveguide 200. However, according to the exemplary embodiment of the present invention, among the regions of the second conductor 103 which are etched to form the non-resonating slot 120, a region of the second conductor 103 which is not etched to be invaginated in a position where the second conductor is connected to the transmission line TL formed by the first pattern of the plurality of vias 110 forms a stub 121. That is, the stub 121 may be formed by masking a region where the stub 121 is formed so as not to be etched, before forming the non-resonating slot 120 by etching the second conductor 103. In FIGS. 3 and 4, as an example, the stub 121 is invaginated in the non-resonating slot 120 to have a rectangular shape, but the stub 121 may have various shapes such as a triangle, a rhombus, or an oval in order to obtain broadband effect in accordance with an impedance matching characteristic.

In the exemplary embodiment of the present invention, the stub 121 is provided to remove impedance mismatching which is caused when the SIW 100 and the waveguide 200 are perpendicularly connected. That is, the stub 121 is provided for impedance matching between the SIW 100 and the waveguide 200. The stub 121 is formed to be invaginated from a center of the transmission line TL toward a center of the non-resonating slot 120 and a length and a width of the stub 121 may be determined so as to perform impedance matching at an operating frequency to be used. Here, the invaginated shape and size of the stub 121 are determined not only by the operating frequency but also by considering various usage conditions such as a size of the waveguide 200, permittivity and a thickness of the dielectric substrate 100, conductivities of the first and second conductors, and a width of the transmission line TL and optimal length and width of the stub 121 may be obtained by an experiment.

In the transit structure of the waveguide and the SIW according to the exemplary embodiment of the present invention, the waveguide 200 is directly coupled to the SIW 100 without having a separate cavity structure, thereby reducing a size. Further, the transit structure is simple so that even when the SIW 100 is configured by a single dielectric substrate 101, the transit structure may operate. Further, the transit structure may be also embodied using only a general PCB process, thereby being manufactured with a reduced cost.

FIGS. 5 to 8 are views specifically illustrating components of the transit structure of the waveguide and the SIW according to the exemplary embodiment of the present invention illustrated in FIG. 3.

Figure 5:
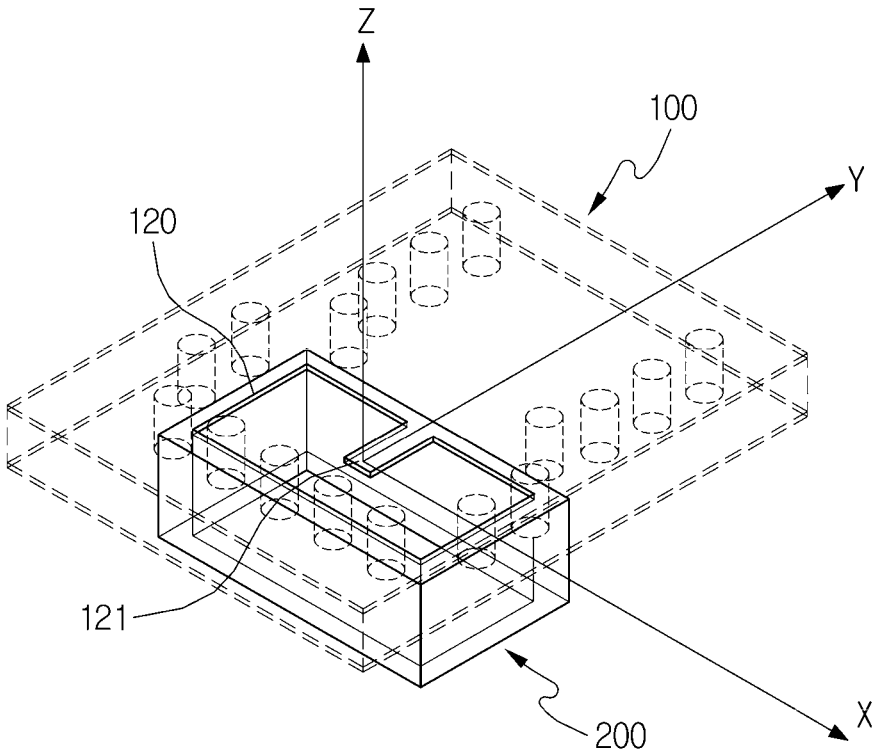
FIGS. 5 to 8 are views specifically illustrating components of the transit structure of the waveguide and the SIW according to the exemplary embodiment of the present invention illustrated in FIG. 3.

FIG. 5 is a view which illustrates a waveguide 200 in detail and as described above, according to the exemplary embodiment of the present invention, a rectangular standard waveguide 200 is directly coupled to a lower surface of the SIW 100 to be perpendicular to each other. The waveguide 200 is directly connected to the lower surface of the SIW 100 to be perpendicular to each other so that a millimeter wave signal, which is applied to the SIW 100 to horizontally proceed, proceeds in the waveguide 200 in a vertical direction. Further, no additional component is provided between the waveguide 200 and the SIW 100 so that the waveguide 200 and the SIW 100 may be coupled with a small and simple structure.

Figure 6:
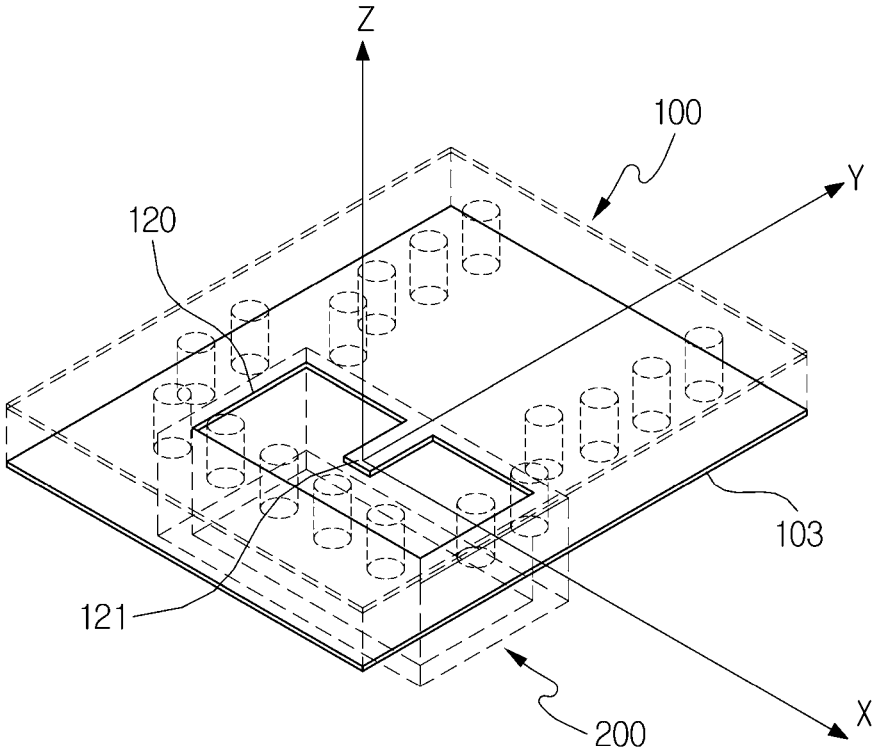

FIG. 6 is a view which illustrates the second conductor 103 of the SIW 100 in detail and the second conductor 103 is disposed on a lowest portion of the dielectric conductor 100 to be directly connected with the standard waveguide 200. A region of the second conductor 103 which corresponds to an aperture of the waveguide 200 is etched to form the non-resonating slot 120 and in a region which is connected to the transmission line TL in the region where the non-resonating slot 120 is formed, the second conductor 103 is invaginated in a direction in which the transmission line extends so as not to be etched to form a stub 121. That is, the stub 121 may be formed such that a region corresponding to the stub 121 is not etched when the second conductor 103 is etched in order to form the non-resonating slot 121.

Figure 7:
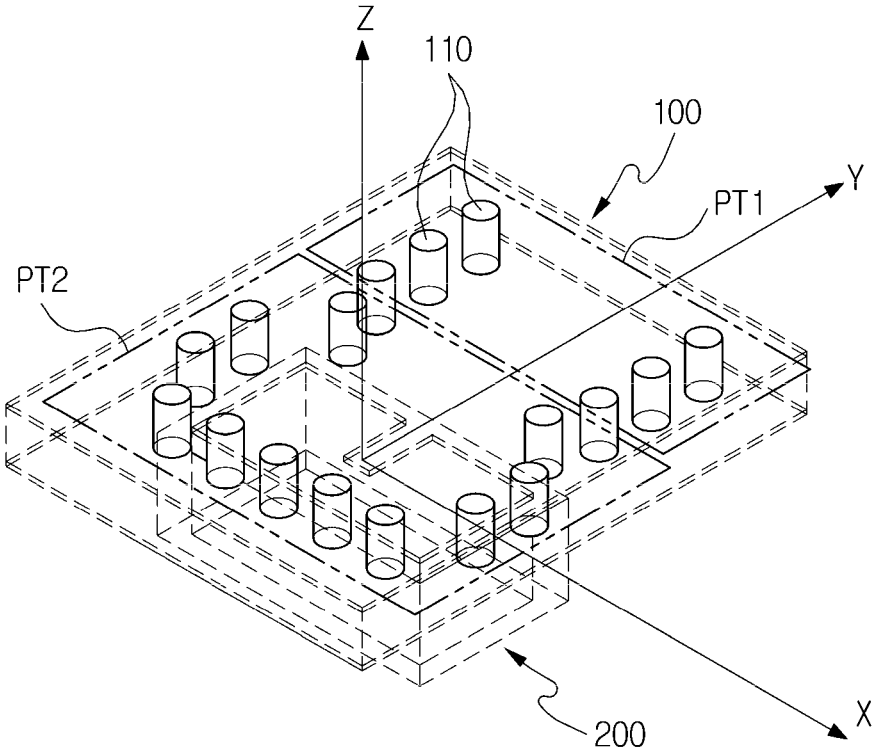

FIG. 7 is a view illustrating a plurality of vias 110 of the SIW 100 in detail and as illustrated in FIG. 7, the plurality of vias 110 is inserted in the dielectric substrate 101 to electrically connect the first conductor 102 and the second conductor 103 and is disposed in accordance with a first pattern PT1 and a second pattern PT2. A plurality of vias which is arranged in accordance with the first pattern PT1 is configured to form two lines of the plurality of vias 110 which is disposed in parallel in order to form the transmission line TL through which the millimeter wave signal is transmitted. Further, the plurality of second vias which is arranged in accordance with the second pattern PT2 forms an impedance matching box so that a signal which is applied through the transmission line TL is transited to the waveguide 200 and the plurality of second vias is configured so as to enclose the non-resonating slot 121 spaced apart from each other with a predetermined first interval. Here, the second vias are not disposed in a position where the second pattern PT2 is connected with the transmission line TL formed by the first pattern PT1.

The plurality of vias which is disposed in accordance with the first and second patterns PT1 and PT2 is disposed to be spaced apart from adjacent vias with a predetermined second interval. The plurality of vias 110 is disposed so as to be spaced apart from adjacent vias with the second interval so that the SIW 100 efficiently transmits the millimeter signal and thus similarly to the stub 121, the second distance needs to be determined by considering various usage conditions such as an operating frequency, permittivity and a thickness of the dielectric substrate 101, conductivities of the first and second conductors, and a width of the transmission line TL. The method of calculating the second distance is a well-known technology so that detailed description thereof will be omitted.

Figure 8:
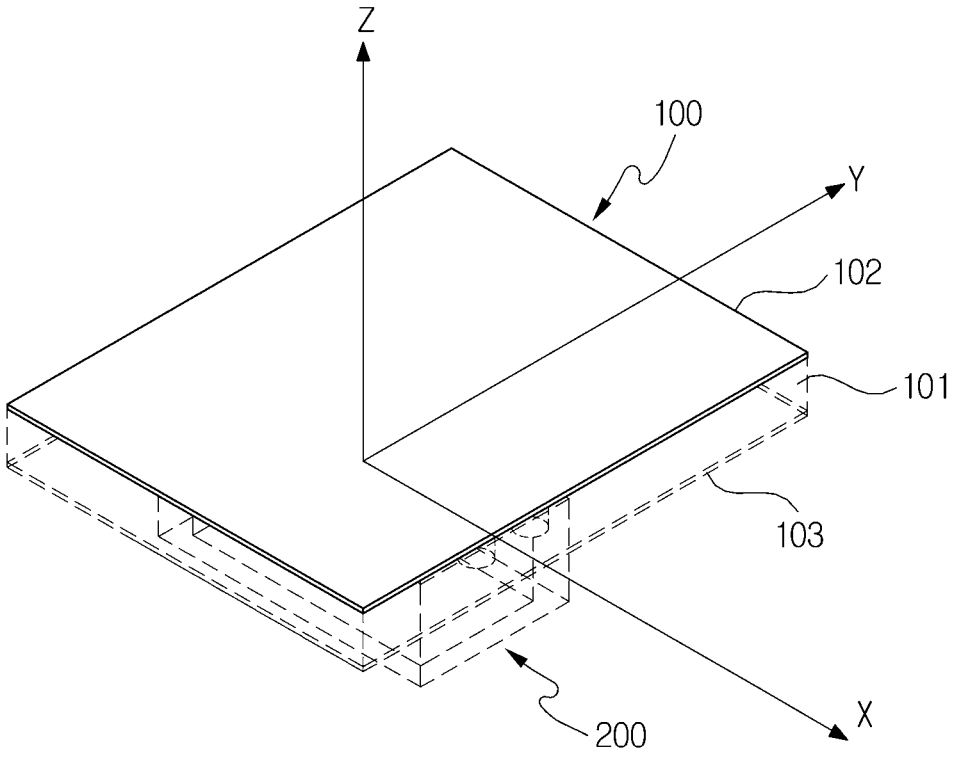

FIG. 8 is a view which illustrates the first conductor 102 of the SIW 100 in detail. Differently from the second conductor 103 illustrated in FIG. 6, the first conductor 102 is not coupled to the waveguide 200 so that the non-resonating slot 120 or the stub 121 is not formed. Accordingly, as illustrated in FIG. 8, the first conductor 102 is formed so as to correspond to the upper surface of the dielectric substrate 101.

In the above description, the standard waveguide is illustrated as an example of the waveguide but the waveguide in the transit structure of the waveguide and the SIW of the present embodiment is not limited to the standard waveguide and other type of waveguide may be used.

Figure 9:
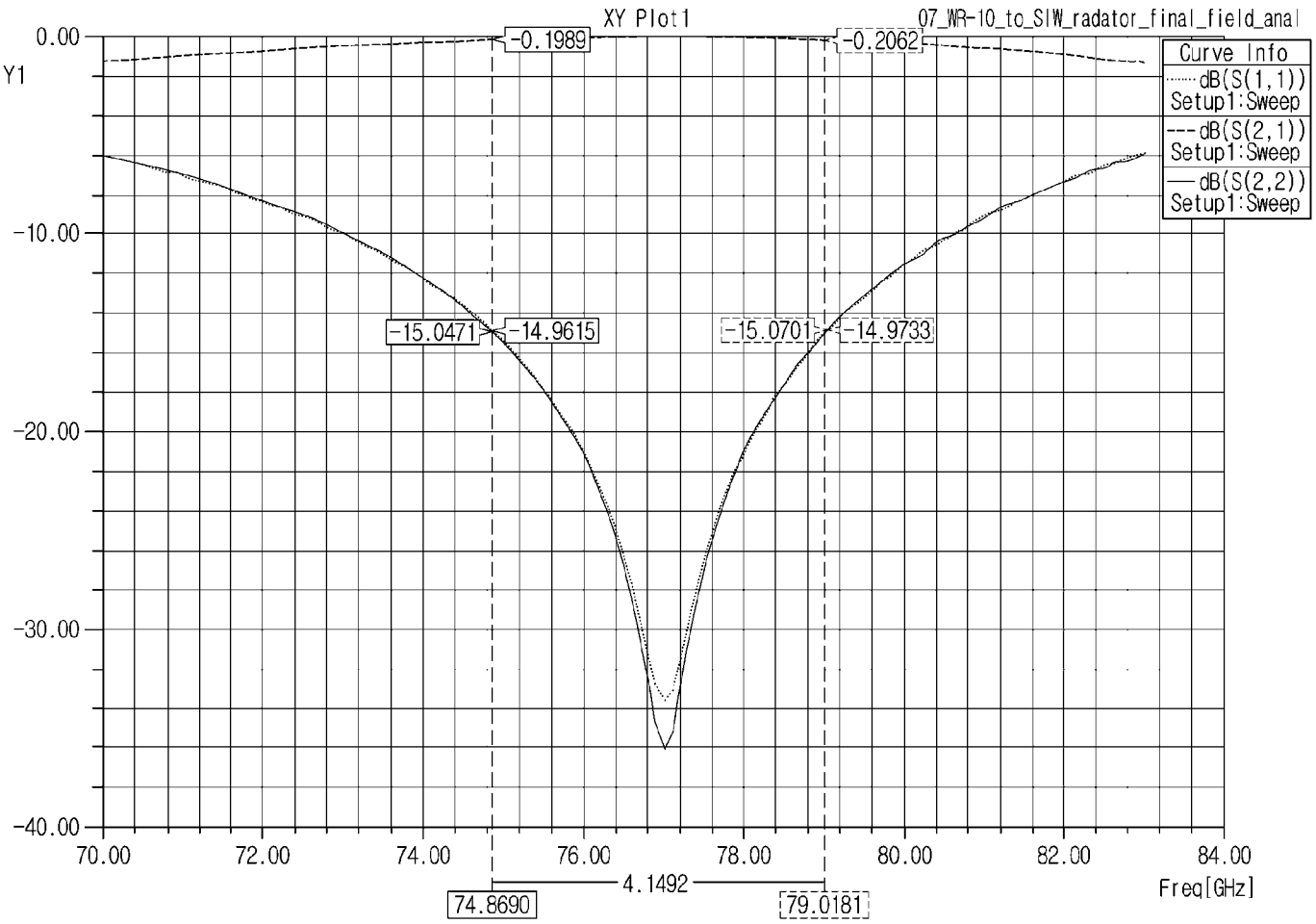
FIG. 9 illustrates a simulation result of a signal transit characteristic at every operating frequency in accordance with the transit structure of the waveguide and the SIW according to an exemplary embodiment of the present invention.

FIG. 9 illustrates a simulation result of a signal transit characteristic at every operating frequency in accordance with the transit structure of the waveguide and the SIW according to an exemplary embodiment of the present invention.

As illustrated in FIG. 9, in the transit structure of the waveguide and the SIW according to the exemplary embodiment, −15 dB bandwidth is approximately 75 GHz to 79 GHz (a range of 4.41492 GHz) with respect to a central operating frequency of 77 GHz. That is, an available relative bandwidth with respect to the central operating frequency is approximately 5.4% of the related art and a signal transmission characteristic in the relative bandwidth has a comparatively flat shape so that signal distortion is small. Further, the impedance matching is easily formed by the stub 121 so that low loss transmission may be performed.

Figure 10:
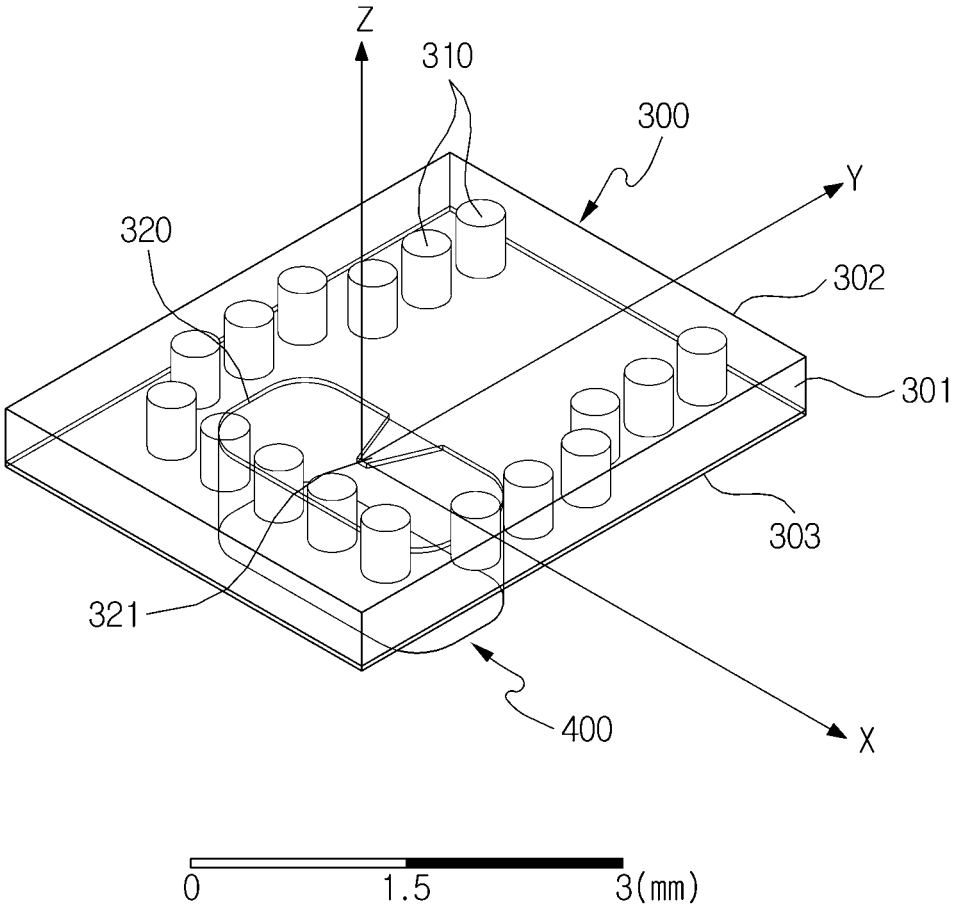
FIG. 10 is a perspective view of a transit structure of a waveguide and a SIW according to another exemplary embodiment of the present invention.

FIG. 10 is a perspective view of a transit structure of a waveguide and a SIW according to another exemplary embodiment of the present invention.

As compared with the transit structure of the waveguide and the SIW of FIGS. 3 to 8, a cross-sectional shape of a waveguide 400 of a transit structure of a waveguide and a SIW of FIG. 10 is not a rectangle. In other words, the waveguide is not implemented as the standard waveguide. The standard waveguide is a waveguide whose shape and size are defined with respect to a frequency to be transmitted and a frequency to be cut-off and thus a required waveguide may be easily designed. However, it is difficult to actually implement a standard waveguide having an exact shape and thus high cost is required. Therefore, generally, a waveguide having a shape which is partially modified from a shape of the standard waveguide is mainly used. In FIG. 10, in order to illustrate a waveguide transit structure which is actually mainly used, a waveguide 400 having rounded corners is used as an example, rather than a rectangular standard waveguide having right-angled corners.

Further, a shape of the stub 321 is also implemented to have a similar shape to a triangle, rather than the rectangle, which is different from those illustrated in FIGS. 3 to 8. In FIG. 10, the stub 321 may be implemented to have a trapezoidal shape having a very short upper edge obtained by chamfering an edge of the triangle or implemented to have a rounded edge. As described above, the shape of the stub 321 of FIG. 10 is formed to obtain a broad band effect in accordance with the impedance matching characteristic and various shapes of stub 321 may be allowed.

Figure 11:
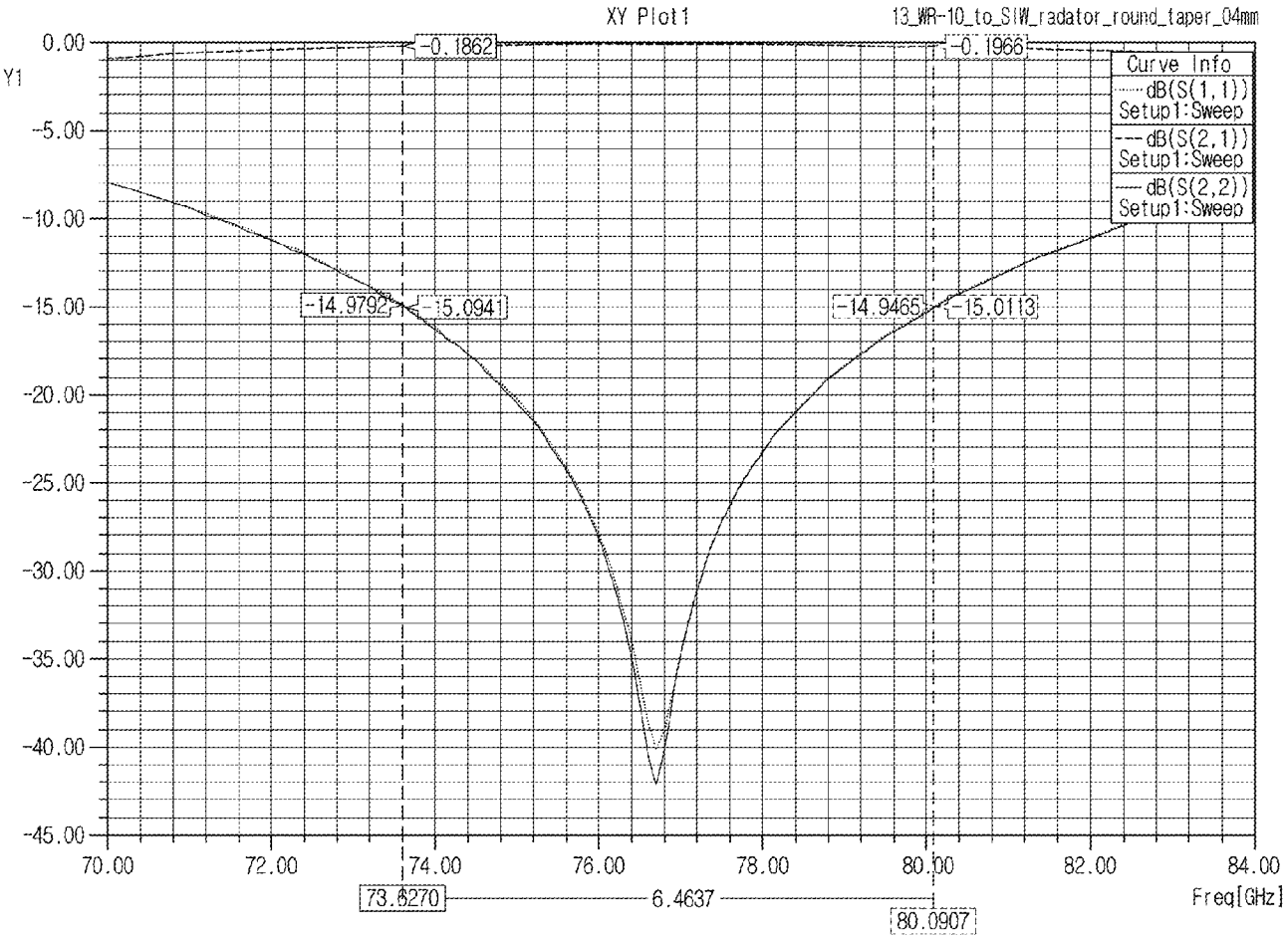
FIG. 11 illustrates a simulation result of a signal transit characteristic at every operating frequency in accordance with the transit structure of FIG. 10.

FIG. 11 illustrates a simulation result of a signal transit characteristic at every operating frequency in accordance with the transit structure of FIG. 10.

When the simulation result of FIG. 11 is compared with the simulation result of FIG. 9, as the shape changes, −15 dB bandwidth is approximately 73 GHz to 80 GHz (a range of 6.4637 GHz) with respect to the central operating frequency. That is, the impedance matching characteristic is changed to obtain broadband effect. Further, the signal transmission characteristic has a comparatively flat shape in the relative bandwidth, so that signal distortion is small and the low-loss transmission may be allowed.

A method according to the exemplary embodiment of the present invention can be implemented as a computer-readable code in a computer-readable recording medium. The computer readable recording medium includes all types of recording device in which data readable by a computer system is stored. Examples of the recording medium are ROM, RAM, CD-ROM, a magnetic tape, a floppy disk, an optical data storing device and also implemented as a carrier wave (for example, transmission through the Internet). The computer readable recording medium is distributed in computer systems connected through a network and a computer readable code is stored therein and executed in a distributed manner.

The present invention has been described with reference to the exemplary embodiment illustrated in the drawing, but the exemplary embodiment is only illustrative, and it would be appreciated by those skilled in the art that various modifications and equivalent exemplary embodiments may be made. Accordingly, the actual scope of the present invention must be determined by the spirit of the appended claims.

What is claimed is:

1. A transit structure comprising:

a Substrate Integrated Waveguide (SIW); and a waveguide having a tubular shape and including a metal, the waveguide being directly coupled to a lower surface of the SIW, wherein the SIW includes:

a dielectric substrate;

a first conductor which is disposed on an upper surface of the dielectric substrate;

a second conductor which is disposed on a lower surface of the dielectric substrate, the second conductor including a stub that has first and second end portions, the first end portion of the stub being electrically connected to an enclosing portion of the second conductor, the enclosing portion of the second conductor being coupled to the waveguide, the stub performing impedance matching between the SIW and the waveguide, the stub and the enclosing portion of the second conductor enclosing a non-resonating slot that corresponds to an aperture of the waveguide; and a plurality of vias which is disposed in the dielectric substrate.

2. The transit structure of claim 1, wherein the plurality of vias includes:

a plurality of first vias disposed in accordance with a first pattern such that the plurality of first vias are arranged along both sides of a transmission path through which a signal is transmitted in the dielectric substrate to form a transmission line; and a plurality of second vias disposed in accordance with a second pattern such that adjacent second vias are spaced apart with an interval along a portion of an outer periphery of the non-resonating slot.

3. The transit structure of claim 2, wherein the second pattern is formed such that the second vias are disposed in first portion of the dielectric substrate that is different from a second portion where the non-resonating slot and the transmission line are connected to each other.

4. The transit structure of claim 3, wherein the stub extends from the first end portion to the second end portion along a central axis of the transmission line and toward an inner portion of the non-resonating slot.

5. The transit structure of claim 4, wherein the stub is formed by masking a region corresponding to the stub in a conductor layer to cause the masked region to remain unetched when an etching is performed on the conductor layer to form the non-resonating slot.

6. The transit structure of claim 5, wherein a shape and a size of the stub are based on at least one of a frequency of the signal, a size of the waveguide, permittivity and a thickness of the dielectric substrate, conductivities of the first and second conductors, and a width of the transmission line.

7. The transit structure of claim 2, wherein the signal is a millimeter wave signal in a band of 70 to 110 GHz.

8. The transit structure of claim 1, wherein the stub has a rectangular shape in a cross-sectional plane that is parallel to the lower surface of the dielectric substrate.

9. The transit structure of claim 1, wherein the stub has a trapezoidal shape in a cross-sectional plane that is parallel to the lower surface of the dielectric substrate.

10. The transit structure of claim 1, wherein the plurality of vias is disposed such that adjacent vias are spaced apart from each other with a predetermined interval.

11. The transit structure of claim 1, wherein the second end portion of the stub is electrically open.

12. The transit structure of claim 1, wherein the stub has a width that is substantially constant from the first end portion to the second end portion, the width being measured in a direction perpendicular to a longitudinal direction of the stub.

13. The transit structure of claim 1, wherein the stub has a width that gradually decreases from the first end portion to the second end portion, the width being measured in a direction perpendicular to a longitudinal direction of the stub, and wherein the waveguide has rounded corners.

* * * * *